US007946245B2

(12) United States Patent
Kipping et al.

(10) Patent No.: US 7,946,245 B2
(45) Date of Patent: May 24, 2011

(54) DEVICE FOR THE HOT-DIP COATING OF A METAL STRIP

(75) Inventors: Matthias Kipping, Herdorf (DE); Bernhard Tenckhoff, Duisburg (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 586 days.

(21) Appl. No.: 11/922,157

(22) PCT Filed: Jun. 22, 2006

(86) PCT No.: PCT/EP2006/006011

§ 371 (c)(1),
(2), (4) Date: Dec. 13, 2007

(87) PCT Pub. No.: WO2007/000277

PCT Pub. Date: Jan. 4, 2007

(65) Prior Publication Data

US 2008/0302301 A1 Dec. 11, 2008

(30) Foreign Application Priority Data

Jun. 25, 2005 (DE) ..... 10 2005 029 576

(51) Int. Cl.
*B05C 3/02* (2006.01)

(52) U.S. Cl. ..... 118/405; 118/419; 118/420; 118/429

(58) Field of Classification Search ..... 118/419, 118/405, 429, 420; 427/431, 433, 435, 436, 427/430.1; 164/461, 419, 498, 147.1; 222/597, 222/599

See application file for complete search history.

(56) References Cited

U.S. PATENT DOCUMENTS

| | | | | |
|---|---|---|---|---|
| 5,702,528 | A * | 12/1997 | Paramonov et al. | 118/623 |
| 6,254,680 | B1 * | 7/2001 | Fligge et al. | 118/405 |
| 2007/0104885 | A1 * | 5/2007 | Hartung et al. | 427/431 |

FOREIGN PATENT DOCUMENTS

| | | |
|---|---|---|
| DE | 11 09 001 | 6/1961 |
| DE | 196 28 512 | 9/1997 |
| DE | 103 30 656 | 1/2005 |
| EP | 0 630 421 | 12/1994 |
| WO | 02/38822 | 5/2002 |
| WO | 2005/001152 | 1/2005 |

* cited by examiner

*Primary Examiner* — Yewebdar T Tadesse
(74) *Attorney, Agent, or Firm* — Lucas & Mercanti, LLP; Klaus P. Stoffel

(57) ABSTRACT

The invention relates to a device for the hot-dip coating of a metal strip (1), more particularly of a steel band, in which the metal strip (1) is guided vertically through a container (3) containing the molten coating metal (2) and through an upstream guide channel (6), in the vicinity of which, on both sides of the metal strip (1), are arranged at least two inductors (8) for generating an electromagnetic field for holding the coating metal (2) in the container (3), a furnace chamber (9), which contains guide means and has a protective gas atmosphere, being located upstream of the guide channel (6). In order to ensure a good, durable seal between the guide channel (6) and the furnace chamber (9) under the established conditions, the invention proposes that a gas-tight, heat-resistant and flexible seal (13) be arranged between the furnace chamber (9) and the guide channel (6).

8 Claims, 1 Drawing Sheet

DEVICE FOR THE HOT-DIP COATING OF A METAL STRIP

Figure 1:
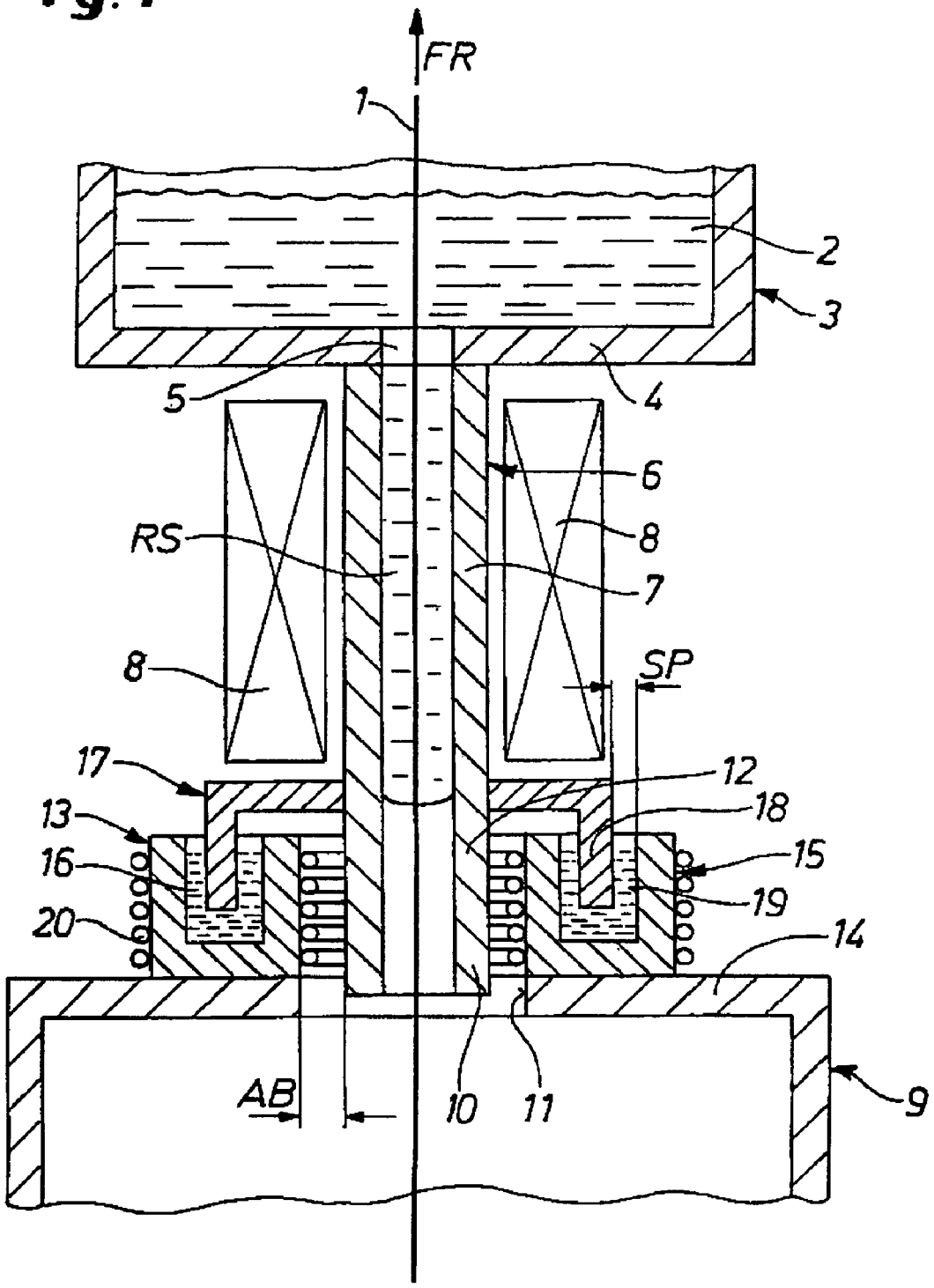

The invention concerns a device for hot dip coating a metal strand, especially a steel strip, in which the metal strand is passed vertically through a coating tank that contains the molten coating metal and through a guide channel upstream of the coating tank, where an electromagnetic field is generated in the area of the guide channel by means of at least two inductors installed on both sides of the metal strand in order to keep the coating metal in the coating tank, and where a furnace chamber that has guide means and is under a protective gas is arranged upstream of the guide channel.

Devices of this type are disclosed, for example, by DE 196 28 512 C1 and EP 0 630 421 B1.

In the devices in accordance with the prior art, it is necessary to ensure that there is an effective seal between the furnace chamber and the guide channel. However, with the furnace temperatures that prevail there and with the heat-resistant materials that are necessarily used, this can present problems, for example, due to the unavoidable relative movements between the guide channel and the furnace chamber.

The objective of the invention is to specify a seal that takes into account the conditions that specifically occur in a device of this general type.

In accordance with the invention, the solution to this problem is characterized, in general, by the fact that, above all, a gas-tight, heat-resistant, and flexible seal is arranged between the furnace chamber and the guide channel.

This combination of properties results in a permanently reliable seal of the transition zone of the guide channel into the furnace chamber.

In a preferred embodiment of the invention, especially the flexibility of the seal is ensured by virtue of the fact that the seal comprises a liquid held in a vessel. In this regard, it goes without saying that both the liquid and the vessel must be able to withstand the temperatures prevailing there.

The liquid is preferably kept in a vessel that consists of an annular trough filled with the liquid, which is tightly seated on or joined to an upper opening of the furnace chamber and extends around a lower section of the guide channel.

To produce a seal towards the top but at the same time creating a certain amount of clearance for movement on all sides, it can then be provided that the vessel includes a cup-shaped cover that is joined with the guide channel and extends around it. The cup-shaped cover has a downwardly extending edge that is immersed in the liquid all around with axial and radial clearance from the inner surface of the trough. Since the immersion depth and the concentricity of the edge relative to the trough can vary somewhat, both axial and radial clearance for movement is ensured.

Especially good means that presented themselves for satisfying the strict requirements with respect to heat resistance were filling the trough with a liquid metal and heating it to ensure that the liquid state is constantly maintained.

If the trough is arranged with a certain amount of radial distance from the lower section of the guide channel, then horizontal clearance for movement is also created in the seal. This horizontal clearance not only can horizontally compensate the aforementioned relative movements but especially can also be used to install a heating system.

In particular, it then becomes possible for the annular trough to be electrically heated by heating lines installed in a compact arrangement on both sides of the trough, i.e., radially.

If the liquid for producing the seal consists of the same metal as the coating metal, such as a molten alloy of tin, light metal, or zinc, then the whole design of the device, including the choice of materials, can be simplified and standardized.

The measures proposed in accordance with the invention make it possible to achieve a flexible connection that allows relative movements in all directions between the guide channel and the furnace chamber, which contains guide means, such as guide rollers, without losing the function of gas-tightness. In particular, the inductors installed around the guide channel are protected in this way from hot gases escaping through untight connection points that develop in the course of the operating time of the device.

The drawing in FIG. 1 shows a specific embodiment of the invention.

The partly crude, schematic drawing in the sole FIGURE shows a central section through a device for hot dip coating with a metal strand 1 passing through it. Only the region of the device that is essential to the invention is shown.

In the section of the device shown in FIG. 1, a metal strand 1 in the form of a steel strip that is to be coated is drawn vertically in direction of conveyance FR through a bath of molten coating metal 2. The coating metal 2 can be especially zinc, aluminum, or an aluminum alloy and is held in a suitable coating tank 3 (shown only schematically here) from which air is excluded.

The bottom 4 of the coating tank 3 contains an opening 5 for the passage of the metal strand 1. A guide channel 6 in the form of a narrow rectangular tube is fitted to and extends downward from the opening 5 in the bottom 4 of the coating tank 3. The strip-shaped metal strand 1 is guided through the guide channel 6 with clearance on all sides. The portion of the guide channel 6 cross section that remains open has the form of an annular gap RS and is filled with coating metal 2 over a certain portion of its vertical extent, so that the metal strand 1 is surrounded by coating metal 2 in the upper section 7 of the guide channel 6. The coating metal 2 thus forms a liquid annular seal, which fills the annular gap RS for a certain axial distance downward.

To ensure the sealing effect of this annular seal, i.e., to ensure permanently reliable sealing of the annular gap RS in the guide channel 6 towards the bottom, inductors 8 are installed on both sides of the longitudinal walls 9 of the guide channel 6.

The inductors induce a strong magnetic field in the region of the guide channel 6. This magnetic field sufficiently counteracts the weight of the coating metal 2 that fills the annular gap RS to prevent the coating metal 2 from escaping at the bottom of the guide channel 6 and to keep it essentially stationary in the guide channel.

The nature of the inductors 8 and their function as well as other features of the device are described in detail in the cited prior-art documents.

The guide channel 6 opens downward into a furnace chamber 9, which has a protective gas atmosphere and guide rollers (not shown) for the metal strand 1. To seal this connection between the guide channel 6 and the furnace chamber 9, the lower end 10 of the guide channel 6 extends downward into the upper opening 11 of the furnace chamber 9 with some clearance. A flexible seal 13 is installed around the opening 11 and around a lower section 12 of the guide channel 6 which is located above the opening 11. This seal 13 is constructed in the following way:

An annular trough 15 with a U-shaped cross section is arranged coaxially to the guide channel 6 and rests tightly on or is joined with the roof 14 of the furnace chamber 9. The trough 15 is for the most part filled with molten metal 16. A cup-shaped cover 17 that is tightly joined with the guide channel 6 coaxially surrounds the lower section 12 of the guide channel 6. This cover 17 has a peripheral, downwardly extending edge 18 that is immersed in the liquid metal 16 and has axial and radial clearance SP from the inner surface 19 of the trough 15.

The trough 15 is arranged an axial distance AB from the guide channel 6. In this annular gap, electric heating lines can be installed on both the inner walls and the outer walls of the trough 15 to keep the sealing metal 16 liquid.

LIST OF REFERENCE SYMBOLS

1 metal strand
2 coating metal
3 tank
4 bottom
5 through-opening
6 guide channel
7 upper section
8 inductors
9 furnace chamber
10 lower end
11 upper opening
12 lower section
13 seal
14 roof
15 trough
16 metal
17 cover
18 edge
19 inner surface
20 heating lines
AB distance
FR direction of conveyance
RR annular gap
SP clearance

The invention claimed is:

1. A device for hot dip coating a metal strand (1), in which the metal strand (1) is passed vertically through a coating tank (3) that contains the molten coating metal (2) and through a guide channel (6) upstream of the coating tank, where an electromagnetic field is generated in the area of the guide channel (6) by means of at least two inductors (8) installed on both sides of the metal strand (1) in order to keep the molten coating metal (2) in the coating tank (3), and where a furnace chamber (9) that has guide means and is under a protective gas is arranged upstream of the guide channel (6), wherein a gas-tight, heat-resistant, and flexible seal (13) is arranged between the furnace chamber (9) and the guide channel (6) and where the gas-tight, heat-resistant, and flexible seal (13) comprises a liquid (16) held in a vessel.

2. A device in accordance with claim 1, wherein the vessel consists of an annular trough (15) filled with the liquid (16), which is tightly seated on an upper opening (11) of the furnace chamber (9) and extends around a lower section (12) of the guide channel (6).

3. A device in accordance with claim 2, wherein the vessel includes a cup-shaped cover (17) that is joined with the guide channel (6) and extends around the guide channel (6) and where the cup-shaped cover (17) has a downwardly extending edge (18) that is immersed in the liquid (16) all around with axial and radial clearance (SP) from the inner surface (19) of the annular trough (15).

4. A device in accordance with claim 3, wherein the annular trough (15) is filled with a liquid metal (16) and is heated.

5. A device in accordance with claim 4, wherein the annular trough (15) is arranged a radial distance (AB) from the lower section (12) of the guide channel (6).

6. A device in accordance with claim 4, wherein the annular trough (15) is electrically heated by heating lines (20) installed on both sides of the trough (15).

7. A device in accordance with claim 2, wherein the liquid (16) consists of the same metal as the molten coating metal (2).

8. A device in accordance with claim 2, wherein the liquid (16) consists of a molten alloy of zinc, aluminum, or tin.

* * * * *